US007484276B2

(12) United States Patent
Jeambar

(10) Patent No.: US 7,484,276 B2
(45) Date of Patent: Feb. 3, 2009

(54) PROCESS FOR MANUFACTURING A COMPOSITE NONWOVEN AND INSTALLATION FOR CARRYING OUT THE PROCESS

(75) Inventor: Patrick Jeambar, Barraux (FR)

(73) Assignee: Ahlstrom Corporation, Helsinki (FI)

( * ) Notice: Subject to any disclaimer, the term of this patent is extended or adjusted under 35 U.S.C. 154(b) by 647 days.

(21) Appl. No.: 10/541,872

(22) PCT Filed: Jan. 13, 2004

(86) PCT No.: PCT/FI2004/000017

§ 371 (c)(1),
(2), (4) Date: Jul. 11, 2005

(87) PCT Pub. No.: WO2004/063451

PCT Pub. Date: Jul. 29, 2004

(65) Prior Publication Data

US 2007/0000107 A1 Jan. 4, 2007

(30) Foreign Application Priority Data

Jan. 14, 2003 (FR) ..... 03 00328

(51) Int. Cl.
*D04H 5/02* (2006.01)
*D04H 1/46* (2006.01)

(52) U.S. Cl. ..... 28/104

(58) Field of Classification Search ..... 28/104, 28/105, 167, 103; 442/384, 385, 387, 389, 442/390, 408, 412, 413; 156/148; 162/115, 162/202, 146, 149, 208, 217, 212
See application file for complete search history.

(56) References Cited

U.S. PATENT DOCUMENTS 3,002,849 A * 10/1961 Harmon et al. ..... 28/105
3,042,576 A * 7/1962 Harmon et al. ..... 28/105
5,151,320 A 9/1992 Homonoff et al.
6,022,818 A * 2/2000 Welchel et al. ..... 28/104
6,163,943 A * 12/2000 Johansson et al. ..... 28/104
6,460,233 B2 * 10/2002 Noelle ..... 28/104

(Continued)

FOREIGN PATENT DOCUMENTS

CA 2 382 186 3/2001

(Continued)

OTHER PUBLICATIONS

International Search Report.

*Primary Examiner*—Amy B Vanatta
(74) *Attorney, Agent, or Firm*—Nixon & Vanderhye P.C.

(57) ABSTRACT

A manufacturing process of a composite nonwoven composed of two webs, respectively, a lower web comprising long artificial and/or synthetic fibres, the size of which is between 15 and 80 mm, and an upper web comprising short natural fibres, the size of which is between 0.5 and 8 mm, characterized, on-line, by: dispersing fist of all the natural fibres into the water; then, putting the aqueous dispersion thus obtained on a carded lower web that is about to form or has been manufactured beforehand; then filtering the excess water through the lower web; then interlacing the fibres of the upper web with the fibres of the lower web with water jets; finally drying and then reeling up the obtained nonwoven composite. An installation for carrying out the process.

19 Claims, 1 Drawing Sheet

U.S. PATENT DOCUMENTS

Figure 1:
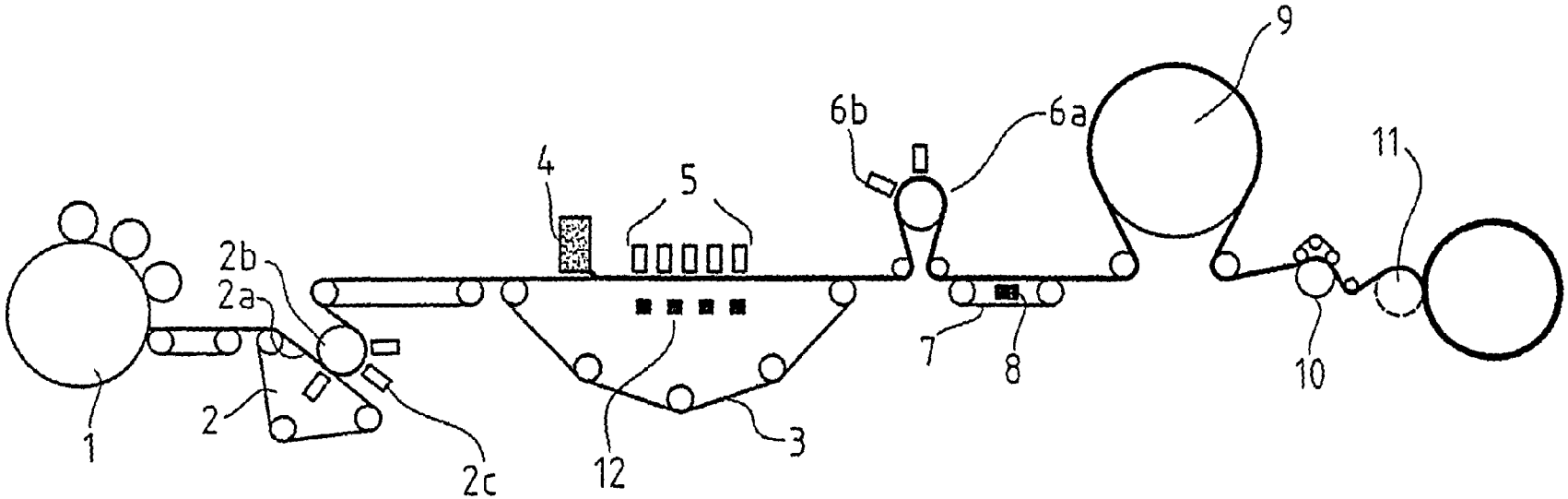

| | | | | |
|---|---|---|---|---|
| 6,516,502 | B1 * | 2/2003 | Moody, III | 28/104 |
| 6,893,522 | B1 * | 5/2005 | Crainic | 156/148 |
| 2002/0160681 | A1 * | 10/2002 | Noelle | 442/408 |
| 2002/0168910 | A1 | 11/2002 | Noelle et al. | |
| 2003/0024092 | A1 * | 2/2003 | Orlandi | 28/104 |
| 2003/0207636 | A1 * | 11/2003 | Gosavi et al. | 442/327 |
| 2004/0010895 | A1 * | 1/2004 | Vonfeldt et al. | 28/104 |
| 2005/0112980 | A1 * | 5/2005 | Strandqvist et al. | 442/416 |

FOREIGN PATENT DOCUMENTS

| | | |
|---|---|---|
| DE | 1 993 8809 | 2/2001 |
| EP | 0 560 556 | 9/1993 |
| EP | 0 826 811 | 3/1998 |
| WO | 01/14624 | 3/2001 |
| WO | 01/53590 | 7/2001 |
| WO | 02/38846 | 5/2002 |

* cited by examiner

PROCESS FOR MANUFACTURING A COMPOSITE NONWOVEN AND INSTALLATION FOR CARRYING OUT THE PROCESS

This application is the U.S. national phase of international application PCT/FI2004/000017 filed Jan. 13, 2004 which designated the U.S. and claims benefit of FR 0300328, dated Jan. 14, 2003, the entire content of which is hereby incorporated by reference.

The invention relates to a manufacturing process of a composite nonwoven composed of two webs, respectively, a lower web comprising long artificial and/or synthetic fibres and an upper web comprising short natural fibres. It also relates to an installation for carrying out of said process.

In the rest of the description, the process of the invention is especially represented in connection with the manufacturing of moisturized wipes. These towels have achieved a great success among the general public and have several important applications especially in the field of hygiene as wiping towels. These towels are in fact used as hygiene articles for a baby or an adult, but also as a disinfectant product e.g. for bathrooms and sanitary appliances. In some cases, the towels are subjected to an embossing treatment i.e. to a treatment allowing obtaining, at the surface of the towel, an embossed and hollow design. In fact, this treatment allows enhancing the design of the towel, but also and most of all, by increasing the specific surface, increasing the wiping capacity.

Most of the towels on the market today consist of carded viscose fibres, possibly as a mixture with synthetic fibres of polyester or polypropylene. However, the high manufacturing cost of the viscose fibres, used because of their absorbing properties, has direct repercussion on the price of the final towel making it an expensive article for the general public.

In other words, an objective of the invention is to reduce the manufacturing cost of this kind of an article by limiting at the maximum, even by eliminating, the usage of viscose fibres.

A first solution to this problem is to put, on a carded web based on synthetic fibres, a paper of the "toilet paper" kind called "tissue" i.e. a finished paper. In practice, the paper, consisting exclusively of cellulose fibres, is set on a carded web made up of polyester, polypropylene or viscose fibres or a mixture of said fibres, then the paper fibres and those of the web are interlaced with water jets. Then the composite is dried before being reeled up.

The obtained composite is still expensive to be manufactured, especially for the following reasons. First of all, the paper of the "tissue" type is a finished paper, manufactured separately on another machine which, of course, generates a manufacturing cost. Furthermore, the paper fibres which have already been dried, thus have a limited wettability so that, in order to be able to interlace them with the fibres making up the lower web, it is necessary to extend the hydration step by multiplying the number of treatments by water jets i.e. the number of the injectors, which, on the one hand increases the equipment investments and on the other hand the energy consumption and thus the cost of the process.

The second technique that has been proposed did not allow solving the cost problem. This technique consists of setting, on a card web, not a finished paper of the "tissue" kind, but cellulose fibres directly by air method, by a process known by the name "air laid". Even if the used cellulose fibres have not been transformed to be present in the form of paper, these individualized fibres have, however, first had to go through a physical-chemical treatment allowing them to be dispersed into the air. Furthermore, this treatment changes considerably the wettability of the fibres so that the interlacing by water jets is difficult to carry out, having as a result a product which tends to delaminate. Finally, the installations for carrying out the "air laid" process are very expensive.

These two techniques are again used in the document U.S. Pat. No. 6,110,848. To be more precise, this document describes a sandwich structure composed of two outer webs of the card web or "spunbond" type comprising long synthetic fibres, the size of which is between 30 and 100 mm, and of an inner web comprising celluloses fibres, the size of which is between 1 and 8 mm. In the described process, the cellulose fibres of the inner web are set on the lower web, either by dry method i.e. in the form of a paper or a "tissue" already manufactured, or by air method. This third process has the same cost disadvantages as the previous processes, to which the cost of the second outer layer may be added.

The document WO 01/53590 describes a manufacturing process of a nonwoven consisting of two webs, an upper web and a lower web, respectively. To be more precise, the upper web is a web of short fibres of the cellulose fibre type, deposited by the wet or aeraulic method of production on a lower web, consisting of continuous filaments of the "spunbond" type.

In practice, the filament denier used in the lower web is less than 1,5, advantageously between 0,5 and 1,2 dtex. Moreover, the mass of the lower web is inferior to 25 g/m$^2$.

The document U.S. Pat. No. 5,151,320 describes also a manufacturing process of a composite consisting of a lower web in form of a "spunbond" and at least one upper web obtained by wet-laid method, that is to say by the wet method of production.

The inconvenience of this type of structure is that it limits the composition of the lower web to the use of synthetic fibres especially of the polypropylene type. Moreover, the very low plasticity of the spunbond type lower web prohibits subjecting the towel to an embossing treatment due to the bad elasticity of the fibres.

The Applicant has developed a new process allowing reducing considerably the manufacturing costs of composite nonwovens, in which a carded lower web based on long synthetic fibres in associated to an upper web based on short natural fibres, consisting, on line, in preparing then setting the upper web directly on the lower web already formed or being formed, by wet method, according to a conventional papermaking technique.

To be more precise, the invention relates to a manufacturing process of a composite nonwoven composed of two webs, respectively, a lower web comprising long artificial and/or synthetic fibres, the size of which is between 15 and 80 mm and an upper web comprising short natural fibres, the size of which is between 0.5 and 8 mm.

This process is characterized, on-line, by:

dispersing first of all the natural fibres into the water, then, putting the aqueous dispersion thus obtained on a carded lower web that is about to form or has been manufactured beforehand, then filtering the excess water through the lower web, then interlacing the fibres of the upper web with the fibres of the lower web with water jets, finally drying and then reeling up the obtained composite nonwoven.

In the rest of the description, the expression "artificial and/or synthetic fibres" denotes the fibres chosen from the group comprising, among the artificial fibres, the viscose fibres, and among the synthetic fibres, the polyester, polypropylene, polyamide, polyacrylic, polyvinyl alcohol and polyethylene fibres, as such or as a mixture.

In other words, the main advantage of the process of the invention consists in using short natural fibres, not transformed or treated, especially cellulose fibres that are dispersed directly into the water by conventional paper-making technology.

Further, the dispersion of the fibres into the water during several minutes gives them plastic properties allowing optimising the efficiency of interlacing by water jets as the dispersion is put on the lower web. It follows that the number of injectors necessary for the bonding is limited, which thus reduces the material investments as well as the energy consumption. In practice, the number of water jets is between 2 and 12, each water jet being equipped with perforated plates, each one of them comprising one or two rows of holes having a diameter of between 80 and 160 micrometers, the holes of each row being spaced 0.4-1.8 mm apart and the rows themselves being spaced 0.5-2 mm apart, each injector being supplied with water at a pressure of between 20 and 140 bars.

As already indicated, the used short natural fibres are in practice cellulose fibres, which can correspond to any paper-making fibres such as e.g. those based on deciduous or coniferous fibres such as beech, birch, pine, red cedar fibres, this list not being exhaustive.

In an advantageous embodiment, the fibres of the upper web are formed by the cellulose fibres for example based on red cedar, the concentration of which in the aqueous dispersion is between 0.5 and 10 g/l, advantageously between 4 and 7 g/l.

However, according to the applications considered for reinforcing or modifying the mechanical properties of the composite, the upper web may further contain synthetic fibres having at the most 50% by weight of the web, advantageously between 20 and 40%.

When fibres of this type are incorporated in the upper web, their length is between 3 and 8 mm.

In practice, the upper web has between 30 and 70% by weight of the composite, advantageously at least 50%.

According to another characteristic of the invention, the lower web is a carded web.

The lower web can be formed on-line or be manufactured beforehand off-line.

In the embodiment according to which the lower web is formed on-line, it is pre-bonded, especially by water jets, before coating it with the aqueous dispersion and this in a manner that reinforces the resistance of the said lower web.

In practice, the lower web represents between 30 and 70% by weight of the composite.

In an advantageous embodiment, the denier of the fibres making up the lower web is superior or equal to 1,7 dtex. Also, the lower web has a mass at least of 25 g/m$^2$.

According to another characteristic of the invention, excess of water coming from the aqueous dispersion of natural fibres, as it is put on the lower web, is filtered through the lower web.

In an advantageous embodiment, the drying step can be preceded by an embossing step of the composite allowing increasing its thickness, but also enhancing its visual appearance. In practice, the embossing is carried out by maintaining the composite on a cylinder, the surface of which has an embossed design and hollows and by injecting water under a heavy pressure on the outer surface of the nonwoven, the excess water being eliminated by suction inside the cylinder. This embossing step is carried out before drying so as to benefit from the plasticity of the fibres in a wet state. This embossing step is favoured by the presence of a carded lower web for and behalf of the prior art spunbond webs, especially those disclosed in the documents WO 01/53590 or U.S. Pat. No. 5 ,151, 320.

In another embodiment, after drying and before the reel-up, the composite, embossed or not, is subjected to a mechanical softening treatment by one of the processes known by an expert of the CLUPAK, SUPATEX, SANFOR or MICREX type.

The nonwovens made with the process of the invention have several advantages. First of all, they are very economic and very absorbent considering the high proportion of natural cellulose fibres representing from 30 to 70% by weight of the composite. Further, they are very regular due to the wet laid method technology of paper production used for the formation of the upper web. Furthermore, they are very resistant because of the presence of the long fibres in the lower web. Further, the combination of natural fibres and synthetic and/or artificial fibres makes the product both comfortable and stable. Finally, the embossing step able to be inserted before the drying step, possibly combined with the mechanical softening treatment, gives the product an appearance and a textile touch especially attractive to the consumer.

Thus, the nonwovens manufactured according to the process of the invention can not only be used as moisturized towels, especially as wiping towels, but also as tablecloth and table napkins, bath towels, wall covering, upholstery of vehicles, depilatory strips, bags for siccative products, gloves, embroidery, cloths and wiping of printing works.

The invention also relates to an installation for carrying out the previously described process.

In a particular embodiment, the installation comprises:

- a conveyor for transporting the carded lower web that is about to form or has already been manufactured,
- a head box set above the conveyor and intended to contain an aqueous dispersion comprising the natural fibres,
- suction means placed under the conveyor and intended to eliminate the excess water as the aqueous dispersion is put on the lower web,
- bonding means by water jets placed above the conveyor and downstream of the conveyor for interlacing the fibres of the upper web with those of the lower web,
- drying means of the composite placed downstream of the conveyor,
- reeling means of the finished dry composite.

In practice, the conveyor is in the form of a metallic or synthetic conveyor perforated in such a way that it allows water to pass therethrough by suction due to suction boxes placed under the said conveyor.

The bonding means by water jets are in the form of several hydraulic injectors provided with perforated plates, each of them comprising one or two rows of holes having a diameter of between 80 and 160 micrometers, the holes of each row being spaced 0.4-1.8 mm apart and the rows themselves being spaced 0.5-2 mm apart, the measures being taken from axle to axle. In practice, the number of injectors is between 2 and 12, each injector being supplied by water at a pressure of between 20 and 140 bars. Beyond this limit, the obtained products cannot be used as towels.

In the embodiment, according to which the lower web is formed on-line, the installation further comprises manufacturing means of the said web placed upstream of the conveyor.

In this hypothesis, the installation comprises, between the manufacturing means of the lower web and the conveyor, a hydraulic pre-bonding unit having a pre-wetting ramp of the web and a support cylinder around which are placed the hydraulic injectors.

In practice, the manufacturing means of the lower web are in the form of a card followed or not by a spreader-coater.

Moreover and in another advantageous embodiment, the installation comprises, before the drying unit, a hydraulic embossing calendar consisting of a suction roll coated with a wire, the surface of which has an embossed design and hollows, the said roll being associated with the hydraulic injectors provided around its surface and equipped with perforated plates of the same kind as those previously described.

For softening the obtained composite, the installation also has, before the reel-up, a softening device.

Moreover and in practice, the drying means are in the form of a cylinder through which hot air passes.

The invention and the advantages which stem therefrom will become clear from the example of the embodiment supported by the appended figure.

The FIG. 1 is a scheme of the installation of the invention incorporating an embossing means and a softening means.

EXAMPLE

A web of 25 g/m$^2$ is produced, which comprises 80% of polyester fibres having a length of 38 mm and 1,7 dtex and 20% of viscose fibres having a length of 38 mm and 1,7 dtex on a card (1) at a speed of 120 meters per minute.

The web thus formed on-line is transferred on a hydraulic pre-bonding unit (2) comprising a pre-wetting ramp of the web (2*a*) and a support roll (2*b*) around which are placed two hydraulic injectors (2*c*). These injectors are provided with perforated plates (not represented) comprising a row of holes, the diameter of which is 100 micrometers and distance between centres 1 mm. The first injector is supplied with water at a pressure of 40 bars and the second with water at a pressure of 60 bars. The web thus strengthened is then transferred on a metallic conveyor (3) above which is placed a head box of the paper-making type (4).

In the head box, a fibre suspension is prepared, which comprises 40% of paper-making cellulose fibres of the "Red Cedar" type having a length of about 5 mm, 40% of paper-making fibres of the "deciduous" type having a length of about 2 mm and 20% of artificial cellulose fibres having a length of 5 mm and 1,7 dtex dispersed into water, the concentration of which is 5 g/liter.

These fibres are then put on the lower web already pre-bonded so that the upper web is formed. An assembly of suction boxes (12), placed under the conveyor, allow eliminating the excess water after deposit of the fibres. This water is recycled and reused for manufacturing of the aqueous solution. The fibres of the upper web are then entangled with those of the lower web by means of five hydraulic injectors (5), placed on the conveyor (3) after the head box (4) and supplied with water at respective pressures of 40, 50, 50, 50 and 60 bars. The first injector is equipped with a perforated plate provided with 2 rows f holes having a diameter of 100 micrometers, spaced 1 mm apart, the distance between the rows of holes being 1 mm. The four following injectors are equipped with a perforated plate provided with only one row of holes having a diameter of 100 micrometers, spaced 0.5 mm apart.

The composite is then transferred on a "hydraulic embossing calendar" (6) consisting of a suction roll (6*a*) around which are placed two hydraulic injectors (6*b*). These injectors are each provided with a perforated plate with two rows of holes having a diameter of 120 micrometers spaced 0,8 mm apart on each row, the rows themselves being spaced 1 mm apart, the injectors being connected to a hydraulic pump delivering water at a pressure of 140 bars. The roll is coated with a bronze wire manufactured with coarse wires, the diameter of which is 1 mm, having a surface in the form of waves made up of hollows and bumps.

The composite is then transferred on a conveyor (7) under which is placed a suction box (8) connected to a vacuum generator supplying with a 4,5 meter water column a depression, which eliminates practically all the water between the fibres.

Then the composite is dried by means of a roll, the diameter of which is 2.8 meters, with hot air going therethrough, the temperature of which is 140° C. (9).

A softening device "Clupak" (10) is set up before the roll before the reel-up (11).

The invention claimed is:

1. A process for manufacturing a composite nonwoven comprised of lower and upper webs, the process comprising the steps of:

(a) forming the lower web of the composite nonwoven by carding artificial and/or synthetic fibres having a length between 15 and 80 mm, and a dtex degree of at least 1.7 dtex, (b) prebonding the carded lower web, (c) dispersing natural fibres having a length between 0.5 and 8 mm into water to form an aqueous dispersion of the natural fibres in water, (d) discharging the aqueous dispersion from a head box positioned over the lower web so as form a layer of the aqueous dispersion on the carded lower web, (e) forming the upper web by filtering excess water from the layer of aqueous dispersion through the lower web, (f) interlacing the fibres of the upper web with the fibres of the lower web with water jets, and (g) drying and reeling up the obtained composite nonwoven.

2. A process according to claim 1, wherein the artificial or synthetic fibres are chosen from the group consisting of viscose fibres, polyester fibres, polypropylene fibers, polyamide fibres, polyacrylic fibres, polyvinyl alcohol fibres, polyethylene fibres, and mixtures thereof.

3. A process according to claim 1, wherein the lower web has a mass of at least 25 g/m$^2$.

4. A process according to claim 1, wherein step (f) is practiced by interlacing the fibres of the upper web with the fibres of the lower web with 2 to 12 water jets, each water jet being equipped with perforated plates which include rows of holes having a diameter of between 80 and 160 micrometers, the holes of each row being spaced 0.4-1.8 mm apart and the rows being spaced 0.5-2 mm apart, each injector being supplied with water at a pressure of between 20 and 140 bars.

5. A process according to claim 1, wherein step (b) includes pre-bonding the lower web with water jets.

6. A process according to claim 1, wherein the lower web comprises between 30 and 70% by weight of the composite nonwoven.

7. A process according to claim 1, wherein the natural fibres are cellulose fibres.

8. A process according to claim 1 ,wherein the upper web further comprises synthetic fibres in an amount of at least 50% by weight of the upper web.

9. A process according to claim 1, wherein the upper web comprises between 30 and 70% by weight of the composite nonwoven.

10. A process according to claim 1, wherein the fibres of the upper web are exclusively cellulose fibres, and wherein the concentration of the cellulose fibres in the aqueous dispersion is between 0.5 and 10 g/l.

11. A process according to claim 1, wherein before drying according to step (g), the process further comprises embossing the composite nonwoven.

12. A process according to claim 1 ,wherein before reeling according to step (g), the process further comprises softening the composite nonwoven.

13. An installation for manufacturing a composite nonwoven comprised of upper and lower fibre webs, comprising:

a carding unit for forming the lower fibre web;

a conveyor for transporting the carded lower fibre web;

a head box positioned above the conveyor for discharging a layer of an aqueous dispersion of fibres in water onto the carded lower fibre web;

a suction unit positioned below the conveyor downstream from the head box so as to cause excess water in the layer of aqueous dispersion on the lower web to be filtered through the lower web to thereby form the upper fibre web therefrom;

a water jet bonding unit positioned above the conveyor and the suction unit downstream of the head box to interlace fibres of the upper and lower fibre webs;

a dryer for drying the upper and lower fibre webs to thereby form the composite nonwoven; and a reeling unit to take up the composite nonwoven.

14. An installation for manufacturing a composite support composed of a lower web comprising long artificial and/or synthetic fibres, and an upper web comprising short natural fibres, the installation comprising:

a carding unit for forming a lower web of the artificial and/or synthetic fibres having a length between 15 and 80 mm, and a dtex degree of at least 1.7 dtex, a conveyor for transporting the carded lower web, a head box set above the conveyor which is adapted to contain an aqueous dispersion comprising the natural fibres having a length between 0.5 and 8 mm and to form a layer of the aqueous dispersion on the carded lower web, a suction unit set under the conveyor to eliminate excess water from the layer of aqueous dispersion on the lower web, a bonding unit including water jets placed above the conveyor and downstream of the head box to interlace the fibres of the upper web with the fibres of the lower web, a drying unit downstream of the conveyor to dry the composite support, and a reeling unit to take up the dried composite support.

15. An installation for manufacturing a composite support according to claim 14, wherein the bonding unit includes between 2 and 12 hydraulic injectors provided with perforated plates, each of the perforated plates comprising rows of holes having a diameter of between 80 and 160 micrometers, the holes of each row being spaced 0.4-1.8 mm apart and the rows being spaced 0.5-2 mm apart, wherein the water jets are supplied with water at a pressure of between 20 and 140 bars.

16. An installation for manufacturing a composite support according to claim 14, further comprising a manufacturing unit placed upstream of the conveyor for manufacturing the lower web.

17. An installation for manufacturing a composite support according to claim 16, further comprising, between the manufacturing unit and the conveyor, a hydraulic pre-bonding unit comprising a pre-wetting ramp for the lower web, a support roll for the lower web, and prebonding hydraulic injectors positioned around the support roll to prebond the lower web.

18. An installation for manufacturing a composite support according to claim 14, further comprising, before the drying unit, a hydraulic embossing calendar comprised of a wire-coated suction roll defining a surface embossed with a design and hollows, and hydraulic injectors positioned around the surface of the suction roll.

19. An installation for manufacturing a composite support according to claim 14, further comprising a softening device positioned prior to the reeling unit.

* * * * *